US009003576B2

(12) United States Patent
Rubin et al.

(10) Patent No.: US 9,003,576 B2
(45) Date of Patent: Apr. 14, 2015

(54) GRAB BAR ASSEMBLY

(75) Inventors: Leila M. Rubin, Sheboygan, WI (US); Michael R. Bates, Sheboygan Falls, WI (US); Nicholas T. Pairolero, Sheboygan, WI (US); Katherine A. Stanchak, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 1376 days.

(21) Appl. No.: 12/039,783

(22) Filed: Feb. 29, 2008

(65) Prior Publication Data

US 2009/0217452 A1 Sep. 3, 2009

(51) Int. Cl.
*A47K 3/024* (2006.01)
*A47K 17/02* (2006.01)

(52) U.S. Cl.
CPC ..... *A47K 17/022* (2013.01); *A47K 2201/02* (2013.01)

(58) Field of Classification Search
USPC ..... 52/35, 34, 312, 147; 4/605, 576.1, 611, 4/612, 571.1, 559; 211/105.1, 119.011; 248/251, 225.21; 251/224.61
See application file for complete search history.

(56) References Cited

U.S. PATENT DOCUMENTS

| | | | | |
|---|---|---|---|---|
| 2,242,461 A | | 5/1941 | Fisher | |
| 3,098,240 A | | 7/1963 | Fleenor | |
| 3,825,229 A | * | 7/1974 | Bartlett et al. | 256/59 |
| 4,817,344 A | * | 4/1989 | Wissinger | 52/35 |
| 5,018,324 A | * | 5/1991 | Lankheet | 52/169.7 |
| 5,279,002 A | * | 1/1994 | Ellis et al. | 4/510 |
| 5,337,525 A | * | 8/1994 | Zaccai et al. | 52/35 |
| 5,542,218 A | * | 8/1996 | Rompel | 52/34 |
| 5,577,275 A | | 11/1996 | Guenther | |
| 5,823,366 A | * | 10/1998 | Bellamy | 211/119.011 |
| 6,298,609 B1 | * | 10/2001 | Bifano et al. | 52/58 |
| 7,124,451 B2 | | 10/2006 | Moore | |

FOREIGN PATENT DOCUMENTS

| | | | |
|---|---|---|---|
| JP | 08004236 | | 1/1996 |
| JP | 08004236 A | * | 1/1996 |
| JP | 2000 220270 | | 8/2000 |
| JP | 2003253851 | | 9/2003 |

OTHER PUBLICATIONS

Translation of JP08-004236.*
Eight pages of a PCT search report of PCT/US2009/000893 dated Oct. 23, 2009 in a corresponding PCT application.
European Search Report (extended) for Application No. 11177811.4-1255 dated Nov. 17, 2011; 7 pages.

* cited by examiner

*Primary Examiner* — Lauren Crane
(74) *Attorney, Agent, or Firm* — Foley & Lardner LLP

(57) ABSTRACT

Grab rail assemblies are disclosed for mounting on walls, such as the tiled walls of a showering area or a mud room. The assemblies are designed to aesthetically meld with the surrounding environment by having a front tile mounting panel. They may also be provided with a drainage system to avoid water collecting long term within the rail when the rail is used in a shower.

20 Claims, 6 Drawing Sheets

GRAB BAR ASSEMBLY

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to decorative grab bar assemblies, particularly those suitable for use in showering areas.

Grab bars are sometimes located within or near bathtubs, shower enclosures and other plumbing fixtures such as toilets to assist persons (e.g. especially the elderly or handicapped) in entering into, sitting upon, or standing for prolonged periods at, such plumbing fixtures. Typically they are mounted on a room or enclosure wall, often directly to framing studs. See e.g. U.S. Pat. Nos. 2,242,461, 3,098,240 and 7,124,451.

Conventional grab rails are tubular and metallic, and thus are highly institutional in appearance. Some homeowners are reluctant to install them (notwithstanding their benefits) because of this. Apart from poor aesthetics, some homeowners may not want visitors to know that they need special assistance in moving relative to plumbing fixtures.

Hence, some companies have tried to incorporate grab rails into more hidden alcoves, so that they are not as immediately noticeable. See e.g. U.S. Pat. No. 5,577,275. However, these rails are typically very short and may not fully meet the need for a rail along a broader expanse of the fixture.

Further, some have tried to partially hide the rail under shields. See e.g. U.S. Pat. No. 5,377,525. However, this has led to undesirable increased costs of manufacturing, assembly and maintenance.

Also, the most traditional metallic materials for such rails can require more frequent cleaning than typical shower area walls do.

Thus, a need exists for improvements with respect to grab rail assemblies, particularly those assemblies suitable to be used in a decorative showering environment.

SUMMARY OF THE INVENTION

The present invention provides a grab bar assembly mountable along a wall. It has an elongated rail positionable on the wall, the rail having an upwardly open recess to facilitate gripping of the rail, and a frontal façade. There is also a decorative layer (e.g. decorative tiles) mounted on the frontal façade.

The wall could be a portion of a showering area. Alternatively, it could be another wall of a bathroom, or even a wall of a mud room or the like. In any event, it is particularly desirable for the wall on which the grab rail is to be mounted to be a tiled wall.

Hence, the frontal façade can be in a form of a tile holder, and the decorative layer can be in a form of a plurality of tiles positioned in the tile holder. Also, the rail can have a wall mount and a grip wall.

Most preferably the grip wall has the frontal façade and also has an upper grip section, there is a drain formed between the wall mount and the grip wall, the wall mount and grip wall are made from extruded aluminum, there is at least one drainage spacer between the wall mount and the grip wall that in part defines the drain, and there is a channel formed in the wall mount that is configured to direct fluid from the channel to the drain. There can also be a spacer between the façade and the decorative layer.

In another aspect of the invention, there can be a grab bar assembly mountable along a wall of a showering area. It has an elongated rail positionable on the wall, the rail having an upwardly open recess to facilitate gripping of the rail, wherein the rail also has a wall mount and a grip wall. There is also a drain formed between the wall mount and the grip wall to permit water entering the upwardly open recess to drain out from the upwardly open recess behind the grip wall. Preferably there is also a drainage spacer between the wall mount and the grip wall.

In yet another form of the invention there is provided an assembled showering area. It has framing, a tiled shower positioned within an area defined by the framing, a stud rail coupled to the framing, and a grab bar assembly of the above type coupled to the stud rail.

It will be appreciated that the present invention permits most of the visible surface of the rail to be made of the same material as the surrounding environment (e.g. identical tiles). Thus, grab rail assemblies of the present invention ornamentally can meld with the aesthetics of the remainder of the enclosure and do not appear institutional in nature.

Importantly, they achieve the secure gripping function without permitting water to collect long term in the rail. This helps minimize the possibility of mold development. Further, they provide a variety of alternative ornamental accessorizing options.

These advantages are achieved at reasonable cost. Hence, they can be implemented as a practical matter.

These and still other advantages of the present invention will be apparent from the detailed description and drawings. What follows is merely a preferred example embodiment of the present invention. The claims should be referenced to assess the full scope of the invention.

DETAILED DESCRIPTION OF THE PREFERRED EXAMPLE EMBODIMENT

The example embodiment is described below in relation to a showering area 10. However, the present invention can be used with other walls such as a tiled wall of a bathroom adjacent a toilet, or a tiled mud room wall where one typically removes outdoor shoes before entering the house.

Figure 1:
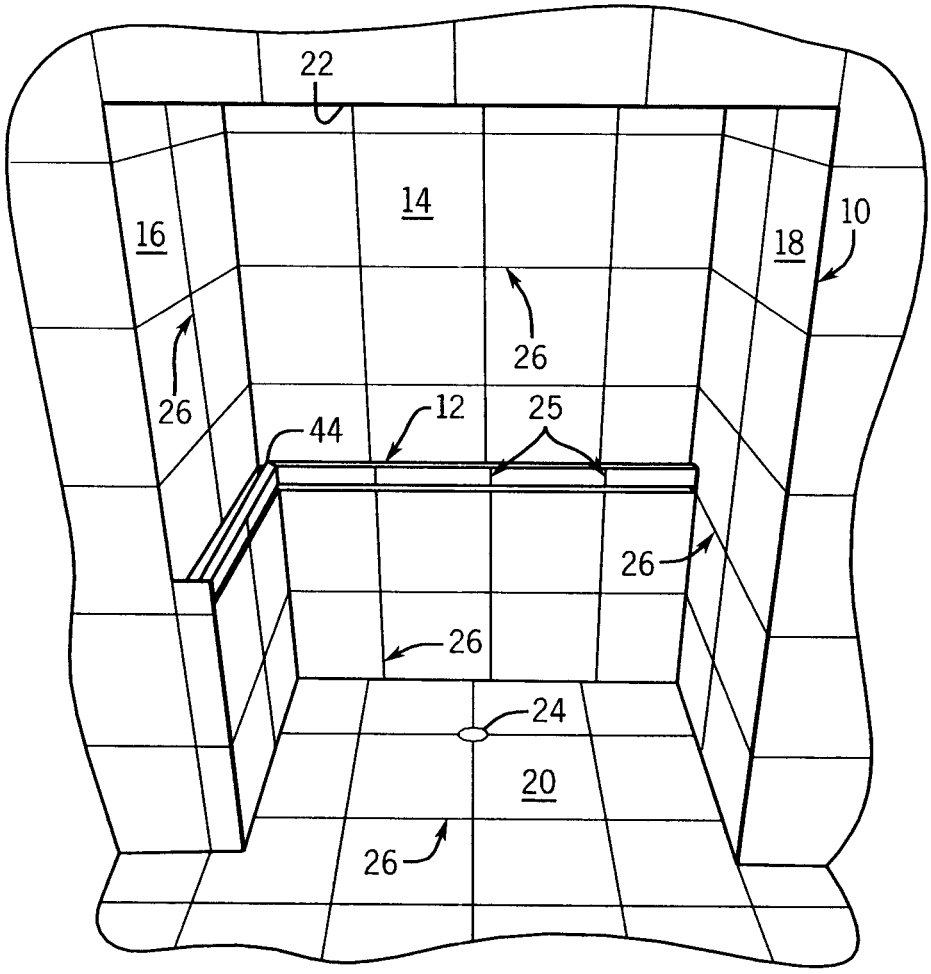
FIG. 1 is a perspective view of a showering area in which a grab rail assembly of the present invention has been installed.

As shown in FIG. 1, there is a grab bar assembly 12 mounted along two sides of the showering area 10. The showering area 10 has a back side wall 14, a left side wall 16, and a right side wall 18. These extend up between the usual floor 20 and ceiling 22.

A shower head (not shown) supplies water to the showering area 10 in the usual fashion. A floor drain 24 extends through the floor 20 to allow water to drain from the showering area 10 when the showering area 10 is in use. Tiles 26 are affixed to the walls 14, 16, 18, floor 20, and ceiling 22 in a conventional manner (e.g., mortar, mastic, resin, or similar bonding method). Alternatively, the walls 14, 16, 18, floor 20, and ceiling 22 may be fiberglass or any other suitable material and construction.

Figure 2:
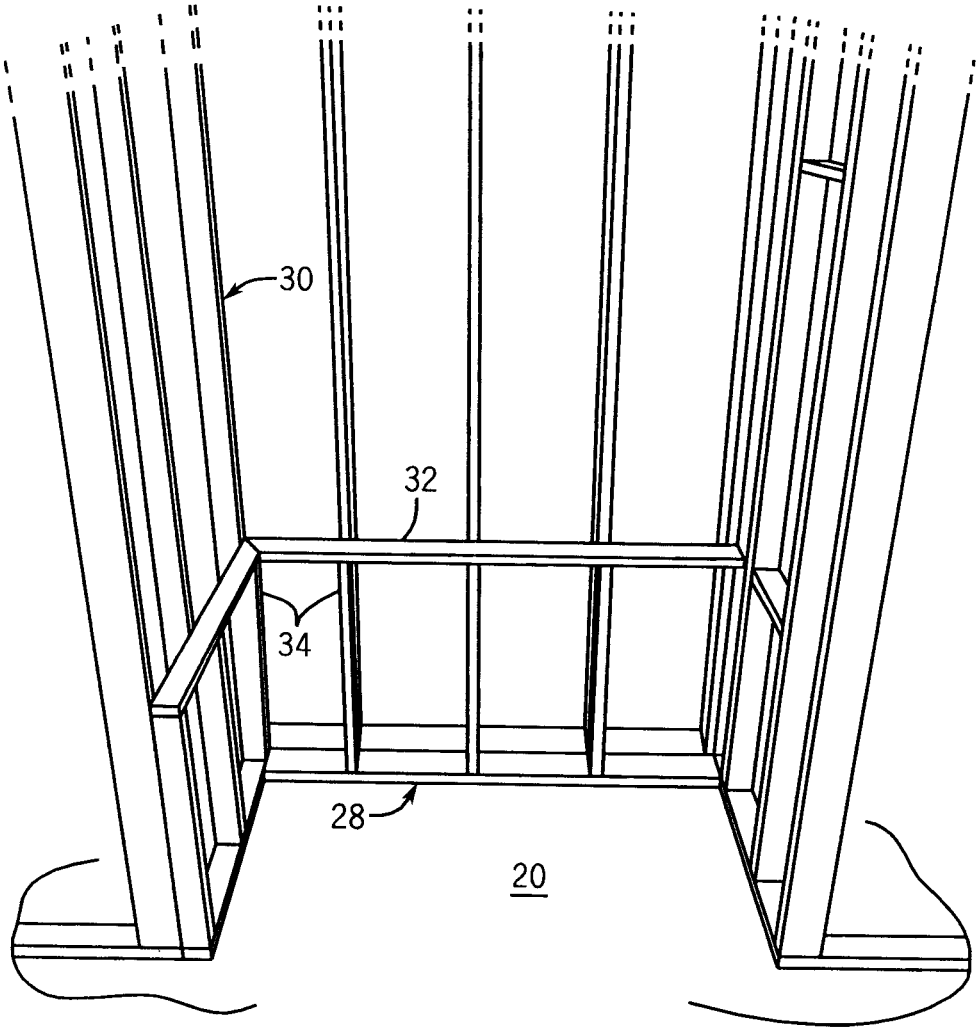
FIG. 2 is a view similar to FIG. 1, but at an earlier stage of installation when the framing studs are visible.

Turning next to FIG. 2, there is shown a stud rail 28 that is coupled to other framing 30. The construction of the stud rail 28 and other framing 30 will vary depending upon the size and configuration of the showering area 10. As will be apparent from the following description, the grab bar assembly is secured to both the stud rail 28 and the other framing 30.

The stud rail 28 extends substantially horizontal with respect to the floor 20 of the showering area 10 along the left side wall 16 and the back side wall 14. The grab bar assembly 12 may be mounted on all, two adjacent, or just one of the walls 14, 16 and 18. There is also a ledge portion 32 of the support rail that can be supported, in part, by the floor 20 via legs 34.

Figure 3:
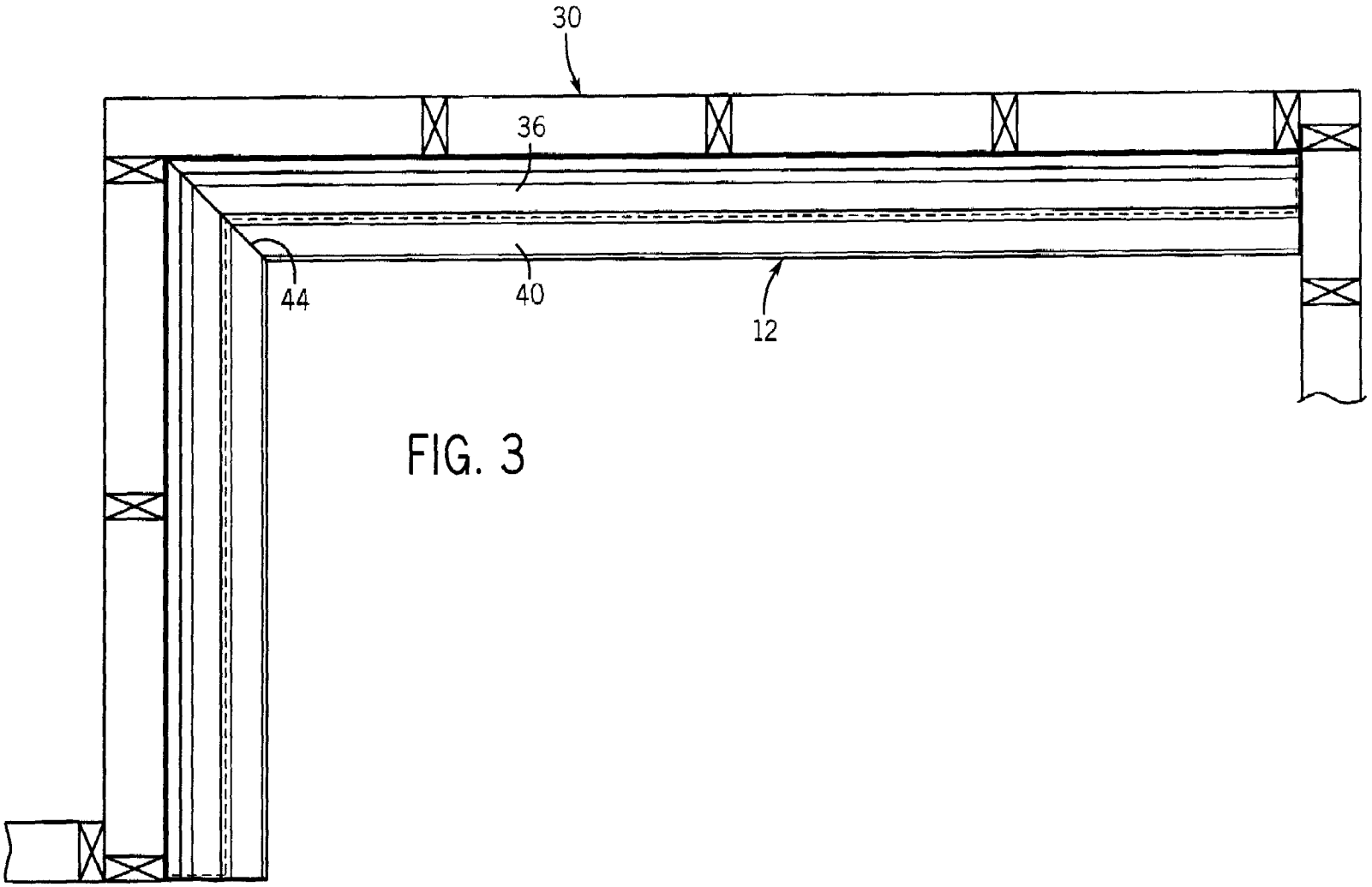
FIG. 3 is a top view of the FIG. 2 framing, with a grab rail assembly also installed.
Figure 4:
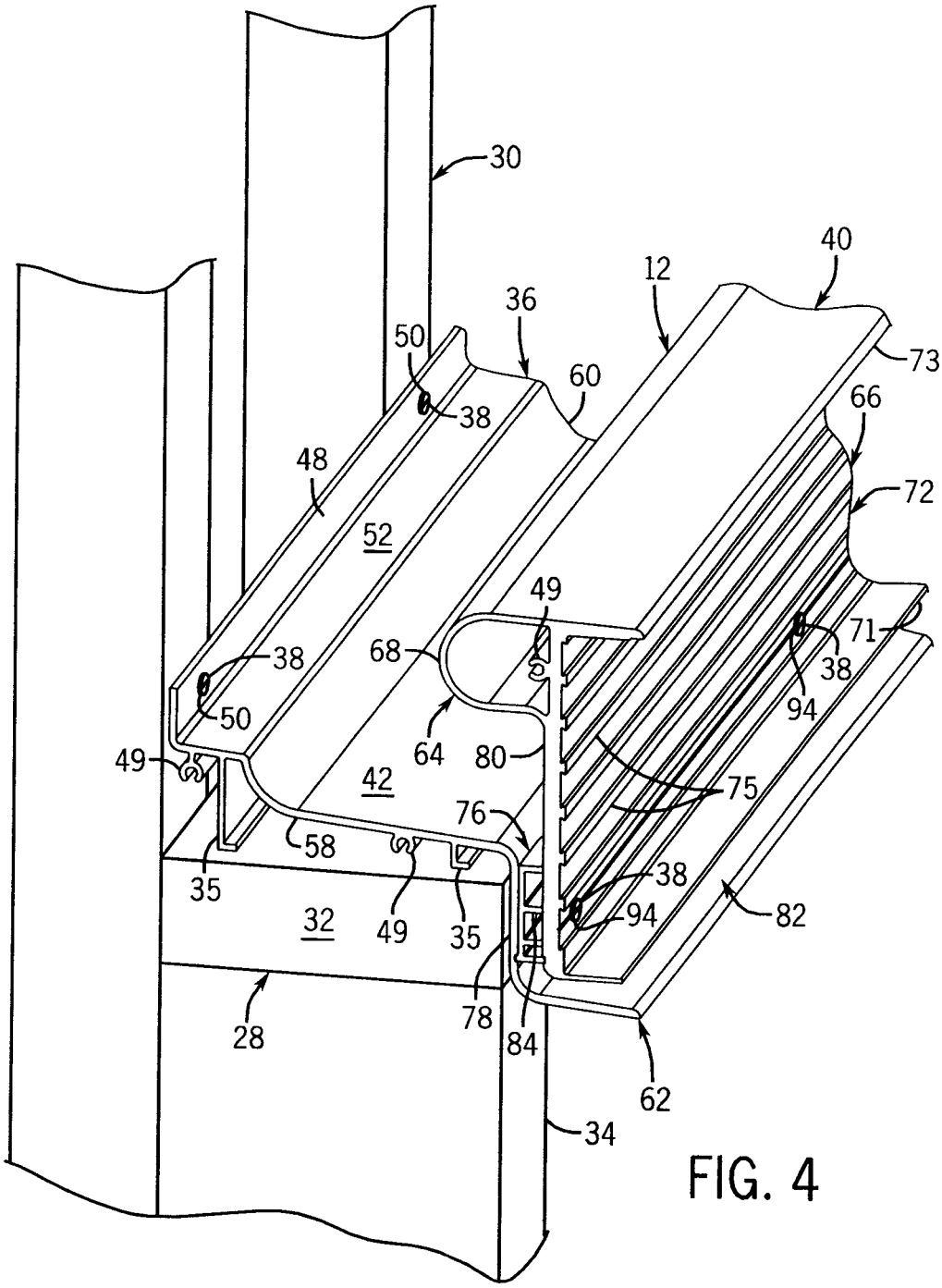
FIG. 4 is an enlarged perspective view of a portion of a grip rail assembly of the present invention, during assembly.

The grab bar assembly 12 is shown mounted to the framing 30 in FIGS. 3 and 4. It has two main portions, a wall mount 36 and a grip wall 40. The wall mount 36 is preferably secured to the framing 30 and stud rail 28 via a series of fasteners 38 (e.g., wood screws, nails, and the like). The wall mount 36 helps define a channel 42 for directing water that may enter a recess 41 defined by the rail when the showering area 10 is in use.

The grip wall 40 is also secured to the stud rail 28 via fasteners 38. The grip wall 40 is configured to be grasped by users at a top and is also coupled to the framing 30.

Figure 5:
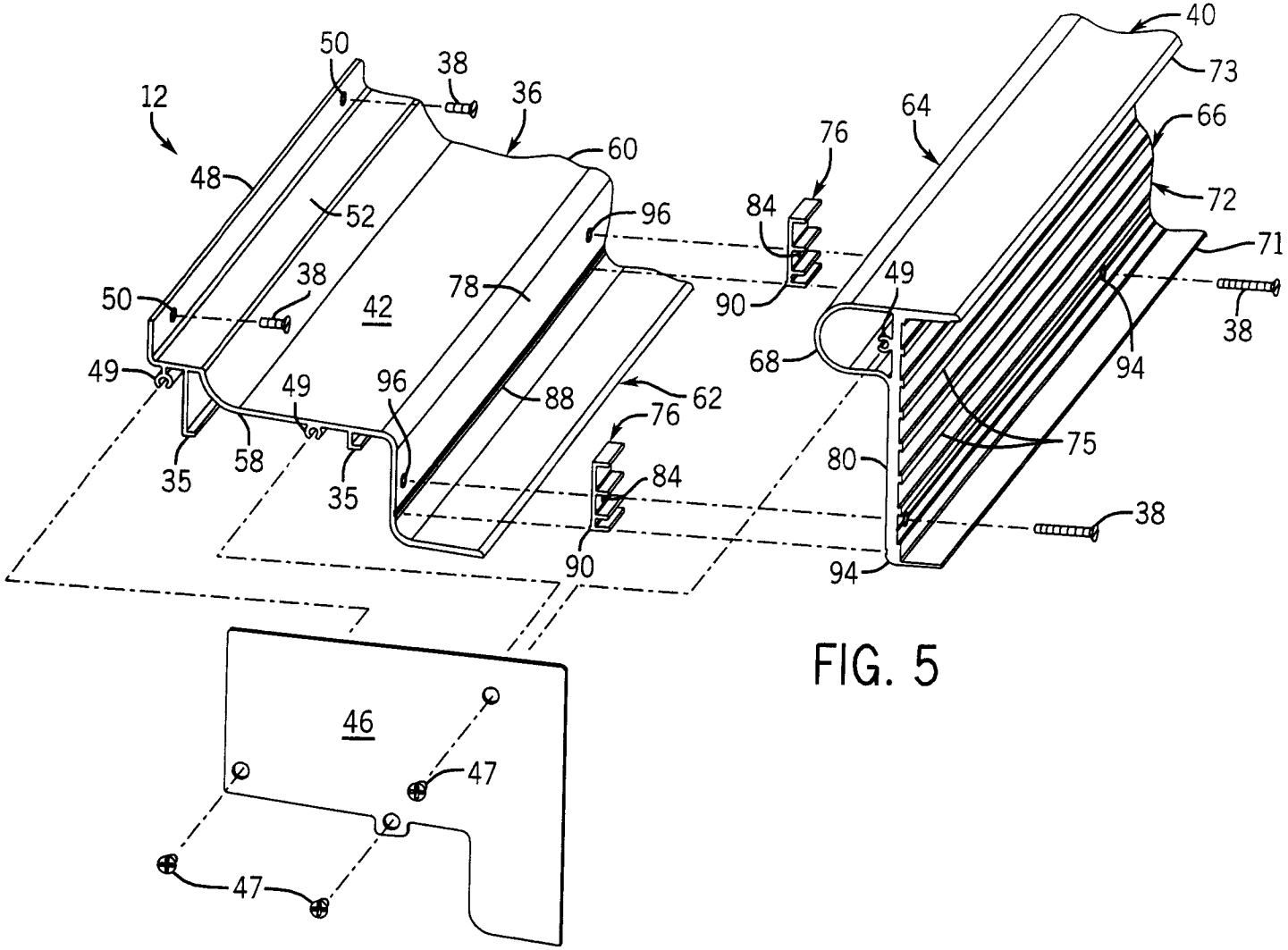
FIG. 5 is an exploded view of certain of the parts of the FIG. 4 grip rail.

The wall mount 36 and grip wall 40 are mitered at an interface formed between the back wall 14 and the left wall 16 to create a mitered joint 44 establishing a uniform transition. In the example embodiment, an end cap 46 (shown in FIG. 5) is secured to the wall mount 36 and grip wall 40 proximate the opening of the showering area 10 via self-tapping screws 47 that extend into a series of pre-formed pockets 49. The pockets 49 are preferably formed as part of the extrusion of the wall mount 36 and grip wall 40.

The end cap 46 prevents forward leakage from the rail. The end cap 46 may be covered by tile, or the end cap 46 may remain exposed. Alternatively, the end cap 46 may take on a variety of configurations to establish a smooth aesthetic transition. A bead of silicone (or the like) can be applied at the junction of the wall mount 36, grip wall 40, and the end cap 46 to prevent water from passing by the end cap 46. Additional sealing may be used to prevent water from flowing between the walls 14/16 to waterproof the mitered joint 44.

The wall mount 36 and grip wall 40 are preferably formed of extruded aluminum. However, a variety of other materials may be used.

It is of note that many of the mounting holes and openings are preferably created "on site" so that the installation of the grab bar assembly 12 can be tailored to each particular installation application. In any event, the wall mount 36 may include an upper mounting strip 48 having a plurality of openings 50 through which the fasteners 38 pass to secure the wall mount 36 to the framing 30.

A horizontal ledge 52 extends inward from the mounting strip 48 to help support and align a substrate 54 and the tiles 26 that are ultimately secured to the substrate 54. A bottom surface 58 of the wall mount includes L-shaped standoffs 35 that rest along the stud rail 28.

An upper surface 60 defines in part the J-shaped channel 42 that directs water within the grab bar assembly 12 away from the walls 14, 16 of the showering area 10. A lip 62 extends downward from the channel 42 to help direct water towards the floor drain 24. As one skilled in the art will recognize, a variety of cross-sections may be used for the wall mount 36 and the grip wall 40. For example, the wall mount 36 may not have the standoffs 35, but may instead be a boxed channel having a lower surface that rests atop the stud rail 28.

The preferred grip wall 40 includes an upper handle or grip portion 64 and a lower facade 66. The upper handle or grip portion 64 is preferably contoured to receive a user's hand. For example, as shown in FIG. 4, the handle or grip portion 64 includes a radius 68 that extends toward the channel 42 for engagement by a user. Additionally, the delineation between the handle or grip portion 64 and the facade 66 may not be distinct, meaning, that the facade 66 may form a part of the handle or grip portion 64 in certain configurations.

The facade 66 defines a generally C-shaped recess 72 in the form of a holder having an upper lip 73 and lower lip 71 for ultimately receiving inlays 25, such as tile, laminate, wood, metal, and the like. It is of note that the recess 72 need not have defined upper and lower bounds, but instead may merely provide a mounting surface for an inlay 25. Additionally, the depth of the recess 72 may be altered depending on the desired aesthetics of the grab bar assembly 12.

In the example embodiment, the recess 72 includes several longitudinal ribs 75 that extend the length of the grip wall 40. The ribs 75 help establish a sturdy bond between the grip wall 40 and the inlays 25.

Particularly importantly, the preferred grip rails include a structure to prevent water from the shower collecting on a long-term basis in the channel 42. The grip wall 40 is spaced apart from the wall mount 36 by a series of drainage spacers 76 that are sandwiched between a vertical portion 78 of the lip 62 and an inner surface 80 of the grip wall 40. A series of drains 82 are therefore defined between the wall mount 36 and the grip wall 40 (between the spacers) such that as water enters into the channel 42 it is directed to the drains 82 to ultimately flow to the floor drain 24.

The drainage spacers 76 are preferably extruded aluminum structures that include an opening 84 to receive a fastener 38, thereby securing it in place. The drainage spacers 76 may be produced from any suitable material (e.g., rubber, plastic, metal, ceramic, and the like), provided a substantially rigid coupling between the grip wall 40 and the wall mount 36 is achieved.

It should now be appreciated that facade 66 is configurable to receive a variety of materials that may be used to better aesthetically integrate the grab bar assembly 12 with the surrounding showering area 10. For example, if the tile 26 of most of the enclosure has a particular nature or appearance, that same tile can cover over most of the grip rail assembly. Further, this largely synchronizes the cleaning need of the grip rail assembly to that of the shower enclosure as a whole.

Figure 7:
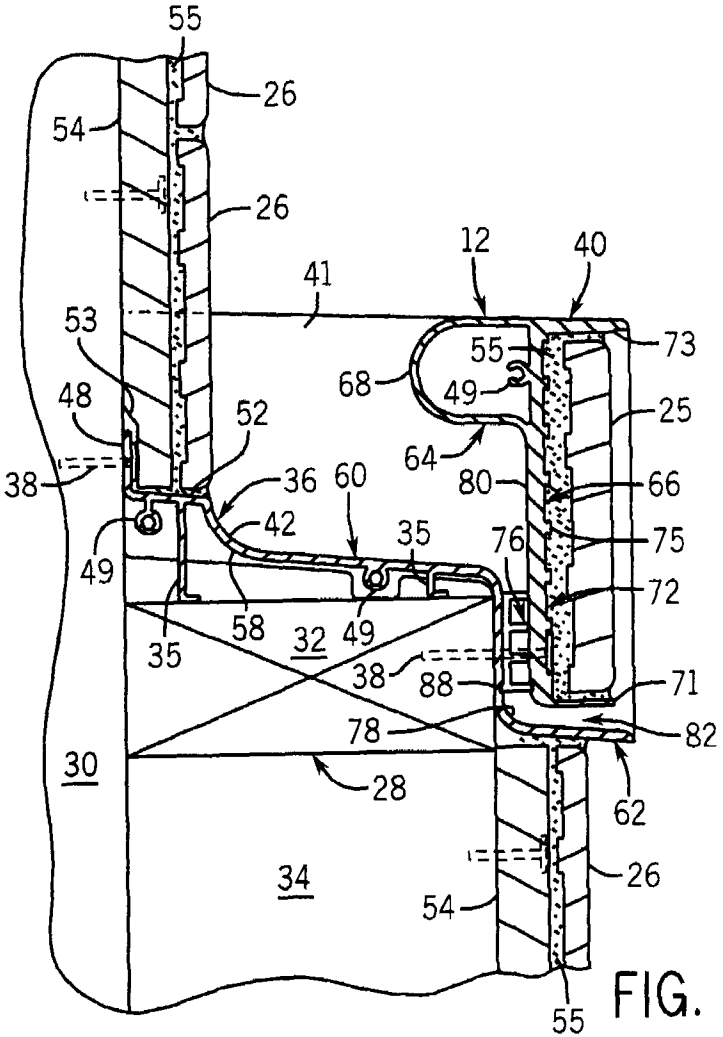
FIG. 7 is a view similar to FIG. 6, but after the tile inlay has been installed.

With particular reference to FIGS. 7 and 8, the inlay 25 is secured directly in the recess 72 via an adhesive 55 (e.g., mortar, mastic, resin, or similar bonding method). In the preferred embodiment, the inlay 25 is configured so that the tile will be flush with the upper lip 73, and protrude slightly beyond lower lip 71. However, this is not critical.

Figure 6:
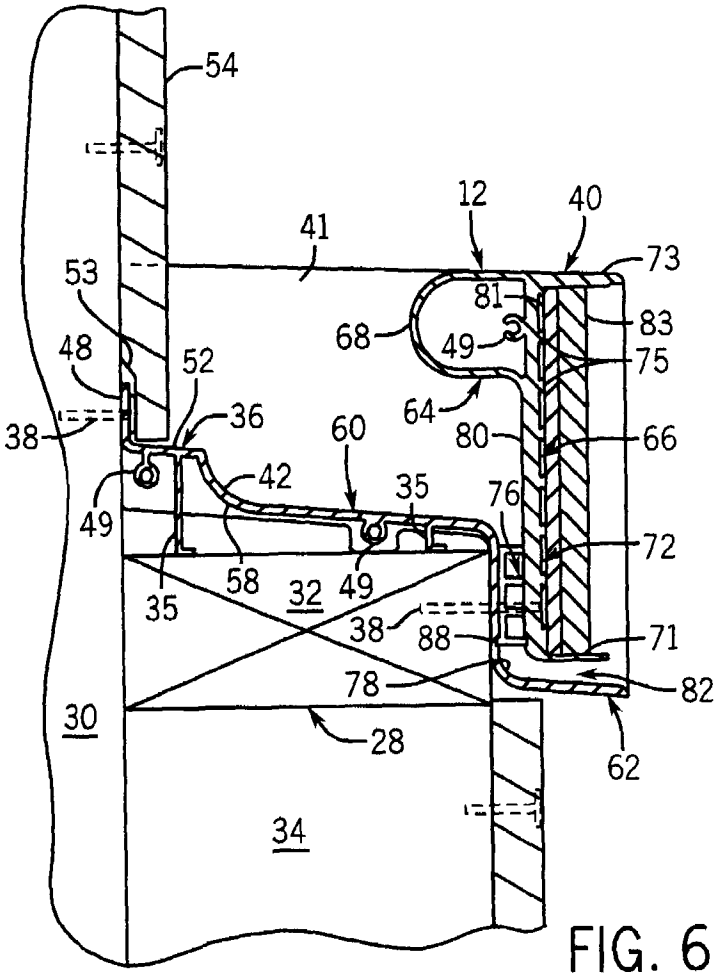
FIG. 6 is a vertical cross sectional view through a portion of the FIG. 1 construction, prior to installation of a tile inlay.

The assembly and integration of the grab bar assembly 12 is shown best in FIGS. 4, 6, and 7. The wall mount 36 is placed on the stud rail 28 and a plurality of fasteners 38 are secured through a series of openings 50 formed in the mounting strip 48 to secure the wall mount 36 to the framing 30. Next, a plurality of drainage spacers 76 are aligned adjacent the vertical portion 78 of the lip 62, preferably aligned with the framing 30. A groove 88 formed in the lip 62 engages a notch 90 extending from the drainage spacers 76 to vertically locate the drainage spacers 76. However, the drainage spacers 76 are preferably horizontally located so that a fastener 38 passes through openings 84 formed therein.

The grip wall 40 is then secured to the stud rail 28 via a series of fasteners 38 that extend through holes 94 formed in the recess 72. The fasteners 38 pass into the holes 94 in the grip wall 40, through the openings 84 formed in the drainage spacers 76, and through a series of openings 96 formed in the vertical portion 78 of the lip 62, to extend into the stud rail 28. Thus, the grip wall 40 helps secure the wall mount 36 to the stud rail 28, and ultimately, the framing 30.

With specific reference to FIG. 6, a substrate 54 having a lower notch 53 is secured to the framing 30 via fasteners 38 and extends proximate the ledge 52 of the wall mount 36. With reference to FIG. 7, a series of tiles 26 are affixed to the substrate 54 via an adhesive 55 (e.g., mortar, mastic, resin, or similar bonding method) or any other acceptable technique.

A series of inlays 25 are affixed to the facade 66 by an adhesive 55 (and the like). Given the thicknesses of the tiles 26 and any particular substrate 54, the depth of the ledge 52 and or recess 72 may be adjusted to achieve a flush appearance between the tiles 26 and the wall mount 36 to establish an integrated appearance of the grab bar assembly 12.

In order to accommodate inlays 25 having a variety of thicknesses, a plurality of spacers 81 (shown in dashed lines in FIG. 6) may be sized to engage the recess 72 of the facade 66 and secured to the grip wall 40 via fasteners (not shown), adhesive, or any other conventional method. In addition, or alternatively, a substrate 83 (shown in dashed lines in FIG. 6), such as cement board, may be sized to engage the recess 72 and be affixed to the spacers 81 to provide both a spacer and an adequate mounting surface for the inlays 25. The substrate 83 may be secured within the recess 72 without the use of an adjacent spacer 81.

While the example embodiment described includes separate drainage spacers 76 and tile spacers 86, either or both of these structures, may be integrally formed in the wall mount 36 and/or grip wall 40. For example, the wall mount 36 or grip wall 40 may include a series of standoffs (not shown) that act as drainage spacers 76 to define the drain 82 when the wall mount 36 and grip wall 40 are coupled. In addition, the tile spacers 86 may be formed integrally with the grip wall 40 where the ultimate thickness of the substrate 54 and tiles 26 are known.

Preferred example embodiments of the present invention have been described in considerable detail. Many modifications and variations of the preferred example embodiment described will be apparent to a person of ordinary skill in the art. Therefore, the invention should not be limited to the example embodiments described.

INDUSTRIAL APPLICABILITY

The invention provides a grip rail assembly for installation on a wall such as a wall of a showering area, particularly where the assembly aesthetically melds with the surrounding environment and avoids collecting water within the grab rail.

We claim:

1. A grab bar assembly mountable along a wall, the grab bar assembly comprising:

an elongated rail positionable on the wall to define a first recess that is upwardly open to facilitate gripping of the rail; and a decorative layer mounted to the elongated rail;

wherein the elongated rail includes a second recess therein, the decorative layer is an inlay positioned at least partially in the second recess, and a horizontal plane extends through a rear-facing surface of the elongated rail and a forward-facing surface of the decorative layer such that when gripping the rail, a user's hand may simultaneously touch both the rear-facing surface of the elongated rail and the forward-facing surface of the decorative layer;

wherein the elongated rail comprises a wall mount and a grip wall;

wherein a drain passageway is cooperatively formed by the wall mount, the grip wall, and a spacer positioned between the wall mount and the grip wall to space the wall mount apart from the grip wall, the wall mount, the grip wall, and the spacer being separately formed members that are coupled together; and wherein the drain passageway extends behind and under the grip wall in order to drain water, the wall mount having a lip that extends under the grip wall.

2. The grab bar assembly of claim 1, wherein the wall is a portion of a showering area.

3. The grab bar assembly of claim 2, wherein the wall is a tiled wall.

4. The grab bar assembly of claim 1, wherein the inlay is in a form of a plurality of tiles positioned in the second recess.

5. A grab bar assembly mountable along a wall, the grab bar assembly comprising:

an elongated rail positionable on the wall, the rail having an upwardly open recess to facilitate gripping of the rail, and a frontal façade; and a decorative layer mounted on the frontal façade;

wherein the rail comprises a wall mount and a grip wall;

wherein a drain passageway is cooperatively formed by the wall mount, the grip wall, and a spacer positioned between the wall mount and the grip wall to space the wall mount apart from the grip wall, the wall mount, the grip wall, and the spacer being separately formed members that are coupled together; and wherein a horizontal plane extends through the drain passageway, the wall mount, the grip wall, and the spacer; and wherein the drain passageway extends behind and under the grip wall in order to drain water, the wall mount having a lip that extends under the grip wall.

6. The grab bar assembly of claim 5, wherein the grip wall has the frontal façade and also has an upper grip section.

7. The grab bar assembly of claim 5, wherein the wall mount and grip wall are made from extruded aluminum.

8. The grab bar assembly of claim 1, further comprising a spacer between a portion of the second recess and the decorative layer.

9. A grab bar assembly mountable along a wall of a showering area, the grab bar assembly comprising:

an elongated rail positionable on the wall, the rail having an upwardly open recess to facilitate gripping of the rail, wherein the rail also has a wall mount and a grip wall;

wherein a drain passageway is formed between the wall mount and the grip wall to permit water entering the upwardly open recess to drain out from the upwardly open recess behind the grip wall; and wherein the drain passageway is cooperatively formed by the wall mount, the grip wall, and a spacer positioned between the wall mount and the grip wall to space the wall mount apart from the grip wall, the wall mount, the grip wall, and the spacer being separately formed members that are coupled together; and wherein a horizontal plane extends through the drain passageway, the wall mount, the grip wall, and the spacer; and wherein the drain passageway extends behind and under the grip wall in order to drain water, the wall mount having a lip that extends under the grip wall.

10. The grab bar assembly of claim 1, wherein the rail comprises a wall mount and a grip wall.

11. The grab bar assembly of claim 10, wherein the grip wall includes the second recess, the rear-facing surface, and an upper grip section.

12. The grab bar assembly of claim 10, wherein a drain is formed between the wall mount and the grip wall.

13. The grab bar assembly of claim 1, wherein the second recess is generally C-shaped having an upper lip and a lower lip for receiving the decorative layer.

14. The grab bar assembly of claim 1, wherein the recess is further defined by a mounting strip having a ledge below the grip portion, and wherein the mounting strip is adapted to be concealed when the grab bar assembly is mounted along the wall.

15. The grab bar assembly of claim 5, wherein the spacer allows a substantially rigid coupling between the grip wall and the wall mount.

16. The grab bar assembly of claim 5, comprising more than two spacers, wherein the wall mount, grip wall, and the spacers define a series of drains.

17. The grab bar assembly of claim 5, wherein the spacer is configured to receive a fastener.

18. The grab bar assembly of claim 17, wherein the wall mount is configured to receive the fastener to mount the grab bar assembly to the wall.

19. The grab bar assembly of claim 10, wherein the first recess is defined at least partially between the wall mount and the grip wall.

20. The grab bar assembly of claim 5 comprising more than one spacer positioned between the wall mount and the grip wall.

* * * * *